United States Patent [19]

Godard et al.

[11] Patent Number: 5,069,368

[45] Date of Patent: Dec. 3, 1991

[54] DISPENSER BODY, A DISPENSER COMPRISING SUCH A BODY AND THE CORRESPONDING DOME

[75] Inventors: Jacques Godard, Sarreguemines; Bernard Schneider, Sainte Menehould, both of France

[73] Assignee: Cebal, Clichy, France

[21] Appl. No.: 486,839

[22] Filed: Mar. 1, 1990

[30] Foreign Application Priority Data

Mar. 2, 1989 [FR] France ..... 89 03414

[51] Int. Cl.[5] ..... B65D 88/54

[52] U.S. Cl. ..... 222/321; 222/385; 222/402.1; 285/242

[58] Field of Search ..... 222/321, 383, 385, 402.1; 285/242

[56] References Cited

U.S. PATENT DOCUMENTS

| | | | |
|---|---|---|---|
| 2,476,446 | 7/1949 | Lindell | 285/242 X |
| 3,718,236 | 2/1973 | Reyner | 222/402.1 X |
| 4,437,588 | 3/1984 | Shay | 222/385 X |
| 4,457,454 | 7/1984 | Meshberg | 222/383 X |
| 4,565,306 | 1/1986 | Nakanishi et al. | 222/389 X |
| 4,940,171 | 7/1990 | Gilroy | 222/402.1 X |

*Primary Examiner*—Kevin P. Shaver
*Assistant Examiner*—Gregory L. Huson
*Attorney, Agent, or Firm*—Dennison, Meserole, Pollack & Scheiner

[57] ABSTRACT

A distributor body comprises a housing having a bottom, a lateral wall secured to the bottom and a top end opposite to the bottom, and a dome sealingly fixed to the top end. The dome is rigid and formed of a plastics material and comprises a central annular portion having a minimal thickness between 1.2 and 4 mm, an upper annular portion and a lower annular portion. The lower annular portion sealingly fixes the dome to the top portion by direct axial fitment. The upper annular portion is adapted for receiving a distribution means such as a valve or pump. The distributor body can be used to dispense materials in the areas of cosmetology, pharmaceuticals, hygiene and foodstuffs.

30 Claims, 5 Drawing Sheets

DISPENSER BODY, A DISPENSER COMPRISING SUCH A BODY AND THE CORRESPONDING DOME

BACKGROUND OF THE INVENTION

1. Field of the Invention

The present invention relates to a preassembled dispenser body on which will be fixed distribution or dispensing means consisting typically of an aerosol valve or a pump surmounted by a nozzle for the distribution of a liquid or creamy product. The invention likewise relates to dispensers comprising such a body and the dome which is used.

2. Description of Related Art

As the document FR-A-2606686 indicates, a metal dispenser casing of the aerosol type is already known which is produced in a single piece by impact extrusion from an aluminum or alloy slug, then by forming of the open upper end of its cylindrical body into a restricted part or dome which is normally surmounted by a rolled edge. This casing will then be filled with a liquid or creamy product and the dispensing valve will be fixed to the top of it by crimping the fixing cup of the valve around the aforementioned rolled edge. In this construction, the restriction of the top end is carried out in several stages and is complicated.

Furthermore, there are casings or housing which are typically of tin and of which the body is cylindrical, the bottom being crimped and the fixing cup of the valve being itself crimped over the top end of the body after the body has been filled with product.

Despite the coatings, these metal/metal crimping or seaming operations do entail risks of corrosion.

The Applicants have sought to perfect a more easily produced dispenser body which does not entail risks of corrosion when it is assembled as a dispenser.

SUMMARY OF THE INVENTION

The first object of the invention is to provide a dispenser body consisting of a housing comprising a bottom and a lateral wall and a dome fixed in fluid-tight manner to the top end of the lateral wall of the casing. According to the invention, this dome is of plastics material and comprises a central annular portion with a minimal thickness of between 1.2 and 4 mm and top and bottom annular portions permitting the mounting of this dome respectively on the lateral wall by direct axial fitment over the bottom portion, and to the dispensing means, the fixing portions extending and enclosing the central annular portion.

This dome which is of plastics material is rigid and its thickness is chosen to ensure that it resists both handling shocks and interior pressure when it is a body of an aerosol dispenser. The dome is itself a moulding which is simple to produce and which is light in weight, its shape which is flared out at the base making it possible to use a tubular housing body or a lateral housing wall, the top end of which is slightly restricted to a normally straight annular portion, that is to say having generatrices of axial directions, or to a portion which carries a rolled edge.

In relation to the case of a metal casing produced in a single piece with the top end restricted to form a dome, the thickness of the lateral wall of a metal casing of a dispenser body according to the invention can therefore only be 0.5 to 0.6 times that which it should be in the known case of a monobloc restricted dome for resisting a given pressure, which is a surprising result and a great economic advantage. In the case of a casing with a prior art restricted dome, the thickness of the wall or at least the thickness of its top part is indeed a function of the deformation and restriction, and this thickness is then typically 1.5 to 1.8 times the thickness which would be needed to resist just the pressure. The slight restriction at the end of the casing according to the invention makes it possible to avoid the extra thickness which is thus linked with the deformation combined with a considerable restriction and it does produce a surprising saving on metal.

The casing may also be of plastics material. In the preassembled dispenser body and in the dispenser obtained with this body, there are only fluid-tight metal/-plastic and possibly plastic/plastic assemblies, eliminating the risks of corrosion which were present in the prior art with metal/metal seams.

Throughout the description, "axial" relates to the direction of the axis of the tubular body or of the lateral wall of the dispenser which is assumed to be upright so that the "top" and the "bottom" are respectively directed at the dispensing means and at the bottom of the casing. "Metal/Plastic" refers to multi-layer materials comprising at least a metal layer and a surface layer of plastics material.

The dome which is of plastics material is fixed in fluid-tight manner on the top end of the tubular body of the casing using methods which are well suited to mass production and which can be gluing, welding of a connecting part, production of a plastics lock either by injection inside the rolled edge which is at the top of the tubular body or by rotating welding (=by friction) of a plastics member held captive by the rolled edge, friction welding on the top end of the casing in the case of a plastics casing. These various methods and the arrangements which result therefrom will be illustrated by the examples. Thus, in accordance with a variety of methods of execution, distributor or dispenser bodies are obtained of which the top ends will be fixed in fluid-tight manner on the fixing cup of the valve or the distribution pump, typically by crimping onto the outwardly reared upper portion of the annular dome.

The annular dome is normally made from one of the materials of the group comprising polyamides, polycarbonates, polyesters, polyacetal, polypropylene and polyethylene.

To comply with the vital factor of resistance to internal pressure in the case of aerosols, for example an internal pressure of 1.2 MPa, or the vital factor of resistance to negative pressure in the case of dispensers fitted with a non-return air pump, the central annular portion around the annular dome has a minimal thickness which is preferably comprised between 1.5 and 3 mm and even more preferably between 1.7 and 2.5 mm.

Moulding of the dome makes it possible easily to obtain an asymmetrical annular portion, the geometry of the dome then being adapted to an oblique or laterally directed distribution. An example will be given.

In the frequent case of a metal casing, the casing is typically of aluminum or an aluminus alloy or of tin plate, these being capable of being coated with plastics material and/or varnish and it is typically either a casing with a monobloc extruded or pressed or drawn-ironed metal bottom or a casing with a fluid-tight crimped metal bottom.

For all the previous cases and typically in the case of an Al or Al alloy metal casing, the restriction at the top end of the tubular body typically corresponds to a difference between overall diameter of the body and the inside diameter of its smaller top opening ranging from 4 mm to at most 12 mm, and the thickness of the lateral wall is reduced as already indicated, corresponding as follows to the outside diameter of the wall, the thickness in parentheses relating to a prior art extruded tubular body:

diam. 33 mm to <47 mm: thickness 0.15 to 0.20 mm (0.30 to 0.35 mm)

diam. 47 mm to <55 mm: thickness 0.20 to 0.25 mm (0.35 to 0.4 mm)

diam. 55 mm to 80 mm: thickness 0.25 to 0.35 mm (0.4 to 0.6 mm).

These restriction and thickness figures are likewise valid for the tin plate casings used according to the invention.

The slight restriction and the remarkable saving on metal associated therewith are considerable advantages of the new structure of dispenser body according to the invention.

For the bodies used in pump dispensers, it is possible to associate with a casing without a metal or metal/plastic or plastic bottom an attached base which is either fluid-tight or which allows air to pass through it when a sliding piston is used. A particularly interesting type of connected base is shown in FIG. 10.

A second object of the invention is a dispenser comprising a dispenser body with an annular dome of plastics material according to the invention, according to any one of its forms of embodiment, and also dispensing means comprising either a dispensing valve of an aerosol or a pump type which takes in either minimal or zero air fitted with a nozzle for dispensing or spraying a liquid or a cream, the fixing collar or cup of the valve or pump being shrunk in fluid-tight manner onto the outwardly bulging top end of the annular dome.

The main types of dispensers according to the invention are therefore:

valve dispensers for distributing an aerosol product, the casing of the dispenser body having a monobloc or crimped on fluid-tight bottom of adequate rigidity;

pump dispensers, the pump preferably being of the non-return type to exclude air for better preservation of the contents;

a) the casing of the body having no bottom or having an attached bottom (=shrunk-on bottom or connected base) which allows air to pass, this casing comprising a sliding piston which is introduced through the bottom end of the casing before any bottom is placed in position;

b) as the casing of the body has a bottom which is either not removable or which is not readily removable and which allows air to pass, the casing being of metal or metal/plastic and its bottom being conventionally monobloc (pressed and drawn casing), this casing comprising a sliding piston introduced therein by its top end, this end then having been restricted for fitment of the annular plastics dome;

c) the casing of the body having a fluid-tight bottom which is not removable or a fluid-tight connected bottom, pumping being carried out with a fixed inner space in the dispenser, and the pump intake orifice or pipe being provided with a plunger tube, this pump is a pump without air return.

It will be noted that when the casing comprises a connected base, the product may be filled through the bottom end of the body: prior to positioning of the piston and then the connected base in the case (a), prior to purely positioning the connected base in the last-mentioned case (c), the dispensing means already being fixed by crimping. Filling through the top orifice of the dome is needed or conventional in all other cases and, it may also be carried out in the preceding cases (a) and (c) after the connected base has been fixed in position.

Finally, the third object of the invention is the annular dome itself which has a structure which is particularly suitable for its fitment on the tubular body and for fitment of the distributor dispensing means. Its annular top end is flared outwardly, forming a crimping ring and its bottom end portion is wider and comprises an open annular groove, the profile of which is partly at least semi-circular, making it possible to fit over the rolled edge of a casing. Its annular disc has a minimum thickness between 1.2 and 4 mm and is framed in the flared top end and a bottom end portion. The bottom end portion may comprise, instead of a groove, a skirt having an annular vertical inner surface which makes it possible for it to fit, with a clearance which is typically less than 0.1 mm at the diameter, over the straight restricted annular portion of the tubular body which is of plastics material or of metal which is coated on the outside with the plastics material of a casing for its fluid-tight connection to this end portion by gluing or welding (typically by induction, ultrasonic waves or rotation). Typically, the minimum thickness of the annular dome is between 1.5 and 3 mm and is preferably between 1.7 and 2.5 mm and the dome is of one of the aforementioned plastics materials, the choice of polyethylene preferred in its high or medium density varieties.

Thus, the advantages of the invention may be summarised as follows:

minimal restriction of the metallic tubular body whatever may be the fixing diameter of the valve or pump, the plastics dome essentially producing the reduction between the diameter of the tubular body and the fixing diameter;

easier and more economical manufacture of the casing whether this is extruded or produced by the other methods described;

standardisation of the casing when the fixing diameter of the valve changes, only the dome being required to match;

a considerable reduction in the thickness of the lateral wall of the casing, typically a relative 35 to 50%;

a considerable reduction in the risks of corrosion at the fluid-tight fixings, only local plastics/metal contact being possible;

simplicity and viability of assembly methods;

simplicity of manufacture of the metal or plastics or metal/plastics casing, using a special connected base in the case of a pump dispenser.

All these advantages are linked with the dissociation between the roles of the various elements of the distributor according to the invention. The dome resists the inner or outer pressure and copes with the difference in diameter between casing and distributing means. The tubular body of the casing resists this same pressure and has a monobloc or connected bottom. Preferably, fluid-tight fixings are metal/plastic.

DESCRIPTION OF THE PREFERRED EMBODIMENTS

Figure 1:
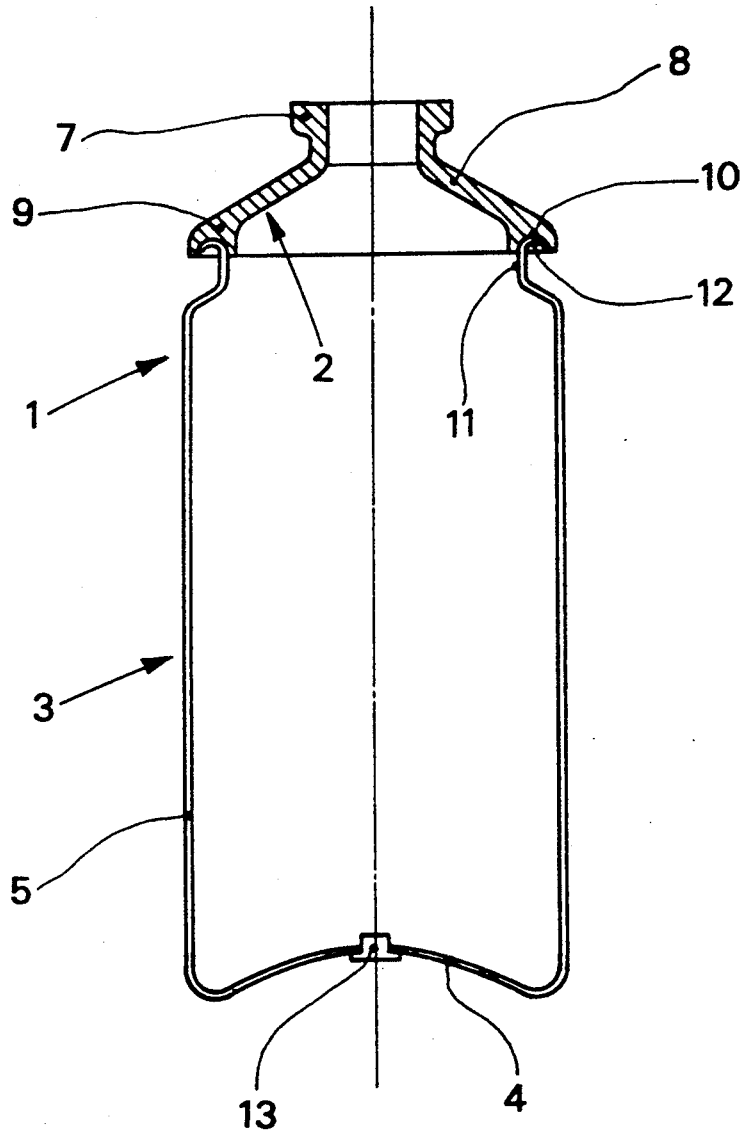
FIG. 1 shows a dispenser body according to the invention in cross-section.

The article (dome+casing) 1 or dispenser body 1 in FIG. 1 comprises a dome 2 of high density polyethylene and a casing 3 of aluminum alloy with a monobloc bottom 4 obtained by pressing-drawing.

At its top end, the dome 2 comprises an outer flaring 7 with an outside diameter of 20 mm constituting a ring 7 onto which the spray means can be crimped. It also comprises below this ring 7 an annular portion 8 of substantially constant thickness 2.3 mm and then a widened lower circular portion 9 with an outside diameter of 45 mm and an inside diameter of 39 mm, comprising at its end an open circular groove 10 of semi-circular at least in part with a radius of 1.5 mm in cross-section and with an average diameter of 42 mm. The total height of the dome 2 is 18 mm.

The casing 3 has a thickness in its cylindrical body 5 of 0.25 mm and a restricted opening 11 with a diameter of 36.5 mm surmounted by a rolled edge 12 over approx. 150° with an outer radius of 1.3 mm. Fixing of the dome 2 on the rolled edge 12 has been carried out by surface oxidation of the circular groove 10 of the dome 2 (Corona treatment) and gluing using cyanoacrylate glue of the groove 10 fitted over the roll edge 12 and maintained for a little more than 30 seconds while the glue dries. The gluing technique employed is the result of tests described hereinafter.

Other known methods of treating the surface of the plastics groove 10 may be used, for example a flame treatment or a shaped electrode treatment (Corona effect). The casing 3 is intended for an aerosol application and its bottom 4 comprises an orifice through which pressurised propellant gas and a stopper 13 for the fluid-tight closure of this orifice can be introduced.

GLUING TESTS

The aforesaid disposition (FIG. 1) has been the subject of a number of gluing tests relating to domes of different materials:

PA 12 (+Rilsan®)
PA 6 (=Nylon®)
PE-HD
PE linear these domes being glued onto the rolled edges at the top ends of aluminum alloy casings with the glue groups:

a silicone glue "Rhodorseal 5552"®
3 cyanoacrylate glues:
No. 406 Loctite®
No. 202 Cyanolit®
No. 208 Cyanolit®

Observations carried out may be summarised as follows: the plastics surfaces must preferably be prepared by surface oxidation such as flaming or Corona effect while the aluminum surfaces must preferably be varnished beforehand, these glues not providing sufficient adhesion to the bare aluminum. Silicone glue requires a pressing time of 1 to 2 minutes and drying times of more than 24 hours at normal room temperature. The three cyanoacrylate glues give similar results: the pressing times may be limited to 5 to 10 seconds and the objects may be handled after 30 seconds to 1 minute at room temperature. These cyanoacrylate glues are therefore highly preferable for industrial application.

Figure 2:
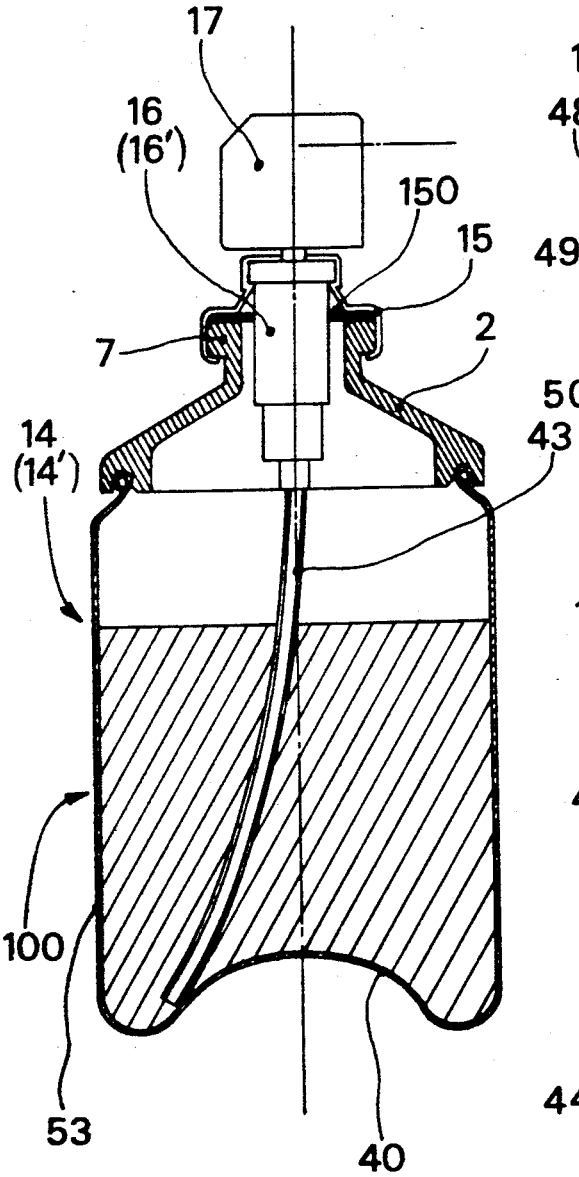
FIG. 2 shows a pump dispenser obtained on the basis of a dispenser body of the same type, in cross-section.

FIG. 2 shows a dispenser body 100 identical to the body 1 in FIG. 1 except that the bottom 40 of its casing 53 which is fluid-tight, has been used to produce a pump dispenser 14. For this, the metal fixing cup 15 of the pump 16 has been shrunk on with a sealing-tight packing 150, the pump 16 in this case being surmounted by a diffuser 17 on the top flared end 7 of the dome 2. This pump 16 is in this case a pump of the non-return type, that is to say with no communication between the inside and the outside of the vessel as is known from documents EP-A-0143183 and EP-A-0251863, which makes it possible properly to preserve the contents. To obtain a satisfactory distribution of the liquid or cream contained in the dispenser, the pump inlet pipe 16 is provided with a plunger tube 43 which extends as far as the bottom 40 of the casing 53, the initial filling of product contained being limited to 70% of the interior volume.

Indeed, tests have shown that with fillings of 80% and more, pumps of the non-return type do not function satisfactorily and that with a 70% filling, functioning was already satisfactory. These tests make it possible to deduce that a 75% filling maximum must be respected in the range of application of the present invention (capacities typically less than 1 liter) in order to obtain trouble-free distribution, the preferred fillings being between 60 and 75%.

Another dispenser body may be used identical to the body 100 in order to obtain an aerosol product dispenser 14' according to the following modification: the pump 16 is replaced by a valve 16' for aerosol fixed on the flared end 7 of the dome 2 by virtue of its fixing cup which is similar to the cup 15 of the pump being fitted by crimping. The dispenser body 100 may thus, as it is, enjoy two types of use.

Figure 3:
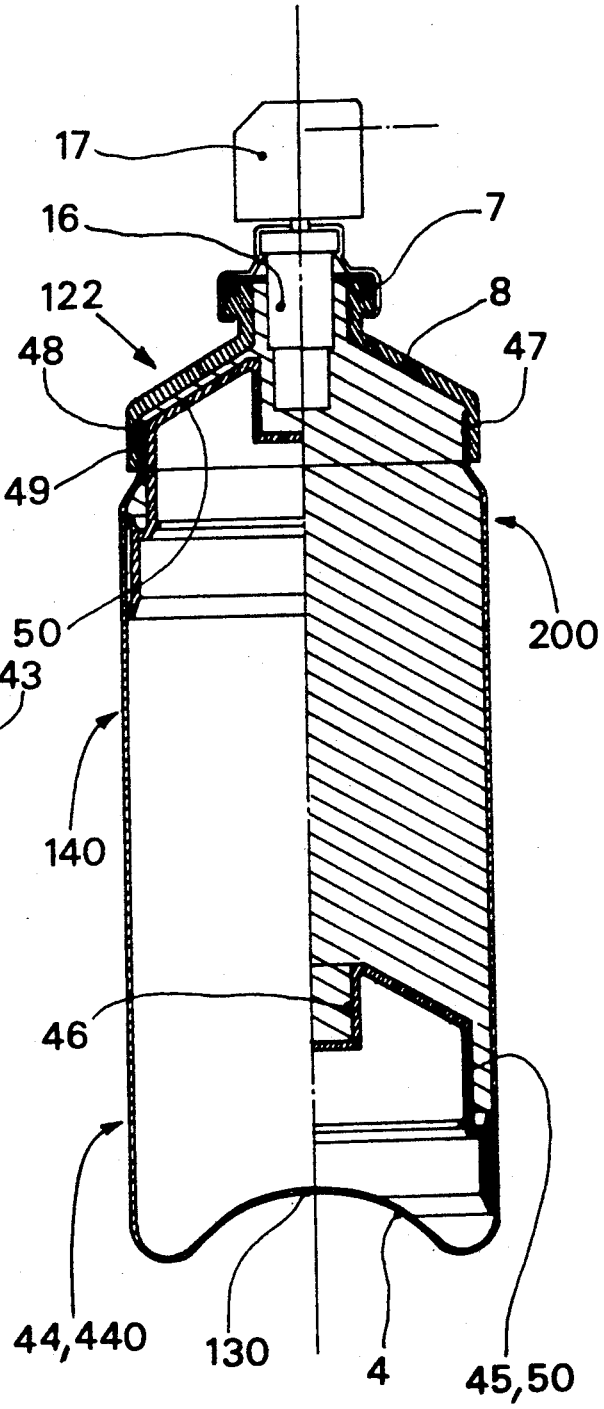
FIG. 3 shows a pump dispenser with a sliding piston obtained on the basis of another preassembled body, the distribution means not being in section and the distributor body being shown according to two partial cross-sections; on the right in the filled state and on the left in the empty state after use.

FIG. 3, a pressed-drawn casing blank 44 identical to that used for the casing 3 in FIG. 1 was used, having an outside diameter of 45 mm and having in its monobloc bottom 4 a through-bore 130 serving here as a passage for air to enable it to be used. Through the top of this blank 44 a sliding piston 45 was introduced and pushed as far as the bottom 4 of this blank 44. The upper surface of this piston 45 comprises a shaft 46 fairly closely surrounding the pump 16 when use of the container ends, ensuring a satisfactory draining of the liquid. The piston 45 thus having been inserted, the top end of the blank 44 is restricted into a circular cylindrical portion 47 having a diameter of 40 mm and a height of 10 mm obtaining the casing 440 used for the preassembled body 200.

In addition, moulding has produced an annular dome 122 of PA12, of which the top end 7 and the thickness and inclination of the annular disc 8 are geometrically similar to those of the dome 2 in FIGS. 1 and 2, and of which the bottom fixing portion 48 consists of a straight circular end skirt 48 of which the inner cylindrical surface 49 of diameter 40.1 mm fits with a slight clearance around the restricted end 47 of the casing 440.

Using cyanoacrylate glue, the dome 122 was then glued onto the restricted end 47 of the casing using the technique described with respect to FIG. 1, obtaining the preassembled dispenser body 200.

After filling with water, crimping was used to fix on the end 7 of the dome 122 a non-return pump 16 identical to that shown in FIG. 2. This pump 16 is of the "VP7" type produced by Etablissements VALOIS (France).

Emptying of the dispenser having been obtained 140 by operation of the pump 16 and by acting on the diffuser 17 which is mounted on top of it was achieved without any difficulty, the trim of the empty dispenser 140 making it possible to establish the final position of the sliding piston 45, the front 50 of which fits with slight clearance inside the restriction 47 and the disc portion 8 of the dome 122 fitting over the pump 16 and causing a better than 97% emptying.

Various methods may be used for mass production of the fixing of the dome 2 to the casing 3. The methods which affect metal casings, typically of aluminum or tin, and with a thickness of 0.2 mm to 0.6 mm, the dispensers being pressurised or not, are commented on hereinafter in connection with FIGS. 4 to 6.

Figure 4:
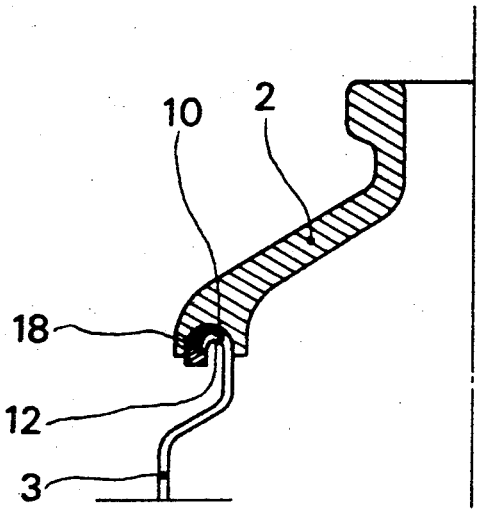
FIGS. 4 to 6 show different methods of fluid-tight assembly of the casing and the dome of the dispenser body, in partial cross-section.

FIG. 4 shows the fixing of a dome 2 having the same geometry as in the first three examples, on a casing identical to the casing in FIG. 1 and using an annular connecting piece 18 compatible with both the plastics material of the dome 2—in this case high density polyethylene—and the metal of the casing 3, in this case a low alloy aluminum. This piece 18, 0.2 mm thick, is a complex containing the same polyolefine as the dome 2, that is to say PE, and also EAA; its outer edge is snapped onto the end of the rolled edge 12 and after the dome 2 has been positioned, its circular groove 10 fitting on the connecting piece 18, welding is carried out by one of the following methods: by high frequency induction, by rotation or even by ultrasonic waves, the shape of the dome being altered to support the ultrasonic transducer.

Figure 5:
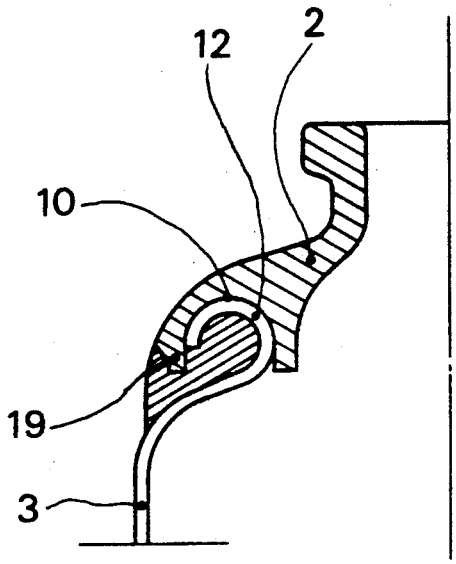

FIG. 5 shows that the dome 2, positioned so that its circular groove 10 is fitted over the rolled edge 12 of the casing 3 has a circular groove end 10 which extends about 1 mm beyond the end of the rolled edge 12 without obstructing the inside of this rolled edge 12. By annular injection of plastics material of the same type as that used for the dome, in this case PE, the cavity inside the rolled edge 12 is at least partially filled, the outer skirt 19 of the dome 2 bordering the end of the circular groove 10 being partially fused, the skirt 19 having at this point a thickness of 1 mm. A good quality fluid-tight welded joint is obtained which is an extension of the skirt 19. Generally, the end 19 of the dome 2 which is thus rigid by virtue of being moulded must come into proximity of the end of the rolled edge, in other words less than 0.5 mm in front of this end or a little farther on, leaving a passage of at least 1 mm towards the interior of the rolled edge 12.

Figure 6:
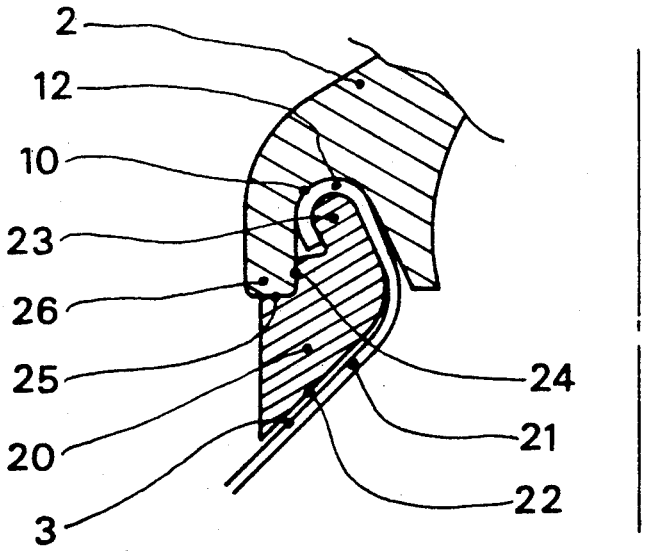

The fixing method shown in FIG. 6 employs an annular shaped member 20 of the same plastics material as that used for the dome 2, the top of which is not shown, this member 20 being positioned on the restricted shoulder or portion 21 of the casing situated in front of the rolled part of the extreme edge. This member 20, in this case made from PE, like the dome 2, comprises a base 22 which bears on the shoulder 21 of the casing 3, an upper portion 23 which will be crimped on as shown by the rolled portion 12 of the top extreme edge of the casing 3, and one or more surfaces, here the vertical surface 24 and the horizontal surface 25, coming in contact with the outer skirt 26 of the dome 2. When the shaped member 20, the rolled edge 12 and the dome 2 have been placed in position, the fluid-tight fixing is carried out by rotary welding of the annular portions 24 and 25 against the annular portion 26 of the dome 2. Fixing may also be carried out by high frequency induction or ultrasonic welding.

Figure 7:
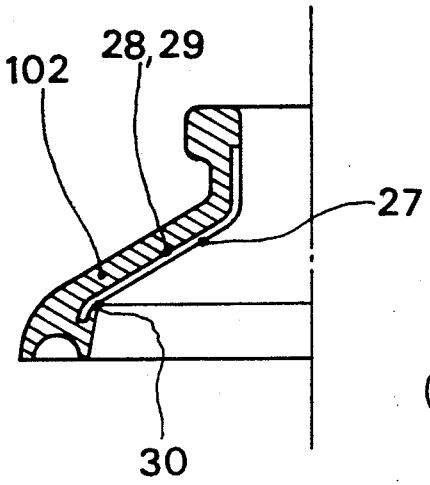
FIG. 7 shows a dispenser body, the dome of comprising internally an insert which forms a barrier for perfumes, in partial cross-section.

As shown in FIG. 7, before being mounted on a casing 3, the dome 102 which has the same geometry as the aforementioned domes 2, is fitted with a barrier effect annular washer 27 while being moulded. This washer 27 is welded to the reverse face 28 of the dome 102 by a large face 29 and is held at the base by a small annular plastics bead 30. Generally it has surface coatings of polyolefine which are compatible with the polyolefine of the dome and an intermediate layer which consists of Al or a plastics barrier material. In this case, a metallo-plastic complex 0.28 mm thick was used for the washer 27 and comprised five layers, i.e. two outer layers of low density PE each 90 microns thick framing two intermediate layers of 30 microns of EAA based adhesive copolymer with a central layer of aluminum 40 microns thick.

Figure 8:
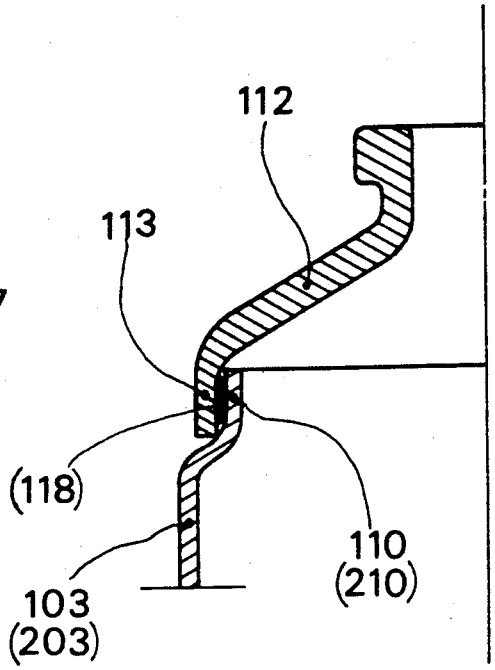
FIG. 8 shows the fluid-tight assembly of a plastics casing and a dome in partial cross-section, and also the case where the casing is metal.

The casing 103 in FIG. 8 is of plastics material, in this case high density PE with a thickness of 0.6 mm in its cylindrical part. This moulded casing 103 has a cylindrical top end 110 with a small outside diameter of 40 mm, whereas the dome 112 has at its bottom end a straight skirt 113 of which the cylindrical inner surface, 39.8 mm in diameter, fits with a tight clamping effect over the end 110. Fixing is then achieved by rotation welding (friction welding).

Alternatively, fixing may be made by gluing, the straight skirt 113 having a diameter of 40.2 mm while the end 110 preferably has slight depressions to retain the glue, depressions which are connected to one another by hollows which form bridges and which are typically 0.03 to 0.08 mm deep.

The same structure may also be used for fixing a plastics dome 112 on the restricted end 210 of a metal casing 203. A connecting ring 118 of the same kind as the connecting piece 18 in FIG. 4 is then placed around the end 210 and welding is carried out typically by high frequency induction or by rotation. The inside diameter of the skirt 113 of the dome 112 and the thickness of the ring 118 are chosen in such a way as to produce a slight gripping effect prior to welding.

Gluing is likewise possible, the inside of the plastics skirt 118 being superficially oxidised beforehand and the outside of the casing 203 being preferably varnished (see gluing experiments in connection with FIG. 1).

Figure 9:
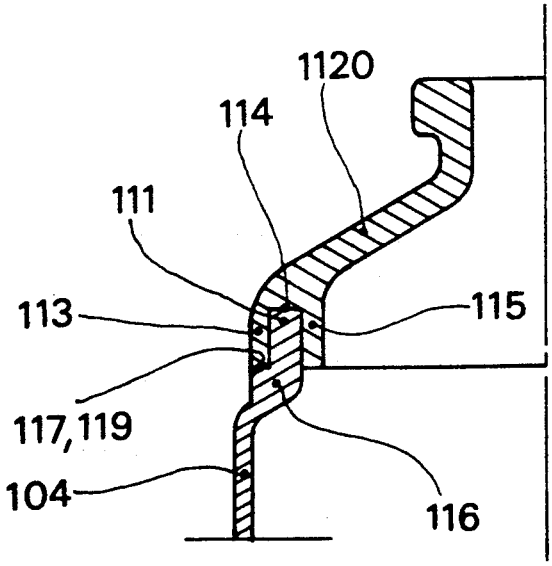
FIG. 9 shows the assembly of another plastics casing and a dome in partial cross-section.

The casing 104 in FIG. 9, like the casing 103 in Example 8, is of high density PE and is 0.6 mm thick in its cylindrical part. This moulded casing has at its top end 116 a neck 111 of rectangular cross-section which fits with a clamping effect between the inner skirt 115 and the outer skirt 113 of the dome 1120, the neck 111 having its horizontal end applied against the bottom of the groove 114. Fixing is preferably carried out by rotation welding; it may also be made by gluing. The horizontal annular surface 119 and the end 117 of the outer skirt 113 of the dome 1120 may likewise be involved in this fixing. In the case of rotation welding, friction is favoured by this arrangement, resulting in good reproducibility of the results of the sealing-tightness obtained.

Figure 10:
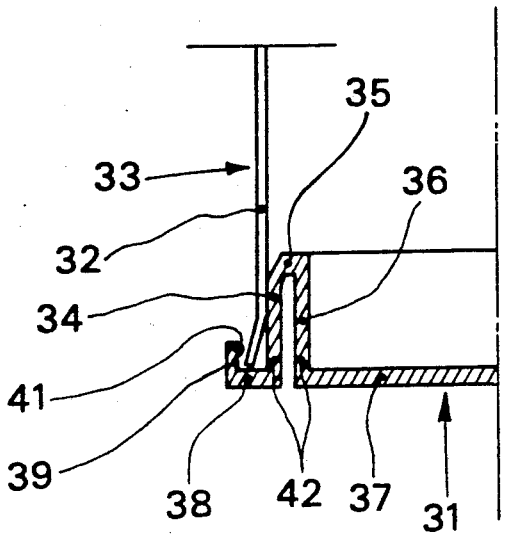
FIG. 10 shows the bottom of a casing provided with a special connected base, in partial cross-section.

FIG. 10 shows a metal casing 33 without a monobloc bottom, consisting therefore of a portion of tube the top end of which is restricted, provided at its bottom end with a connected base 31, the lateral wall 32 of this casing being force-fitted around the tubular outer wall 34 of a connected base which consists of polyethylene (PE).

This outer wall 34 is connected at the top 35 to an inside wall 36 with which it forms a flexible and open-bottomed annular fold 42, that is to say a member in which the spacing can be modified for any part of the periphery, the inner wall 36 surrounding a central base 37 which extends it in sealing-tight fashion and the outer wall 34 being surrounded by an edging 38 which is easy to deform transversely and elastically by virtue of its minimal width and limited thickness.

This attached base 31 which can be used for other types of receptacle, acts as a diameter compensator and ensures satisfactory sealing-tightness in the event of ovality corresponding to differences in diameter which do not exceed twice the average interior width of the annular fold 42. It tends to restore roundness to the wall 32 of the casing 33 when this wall is semi-rigid. The edge 38 is in this case provided with an outer returned edge 39 which makes it possible to protect the bottom end of the lateral wall 32 of the casing 33. This returned edge 39 carries an inner annular relief 41 which holds the slightly flared end of the wall 32. And this wall 32 grips a certain height of the outer wall 34 of the base 31. The resultant arrangement lends itself readily to gluing to create a final fixing but it is particularly suitable for dispensers fitted with a non-return or minimal return pump working with a vacuum inside the dispenser.

The connected base 31 which has an annular deformable fold 42 is 1 mm thick and its dimensions are as follows:

inside and outside diameter of the inside of the annular fold 42: 47.5 and 50.5 mm;

width of the bottom of the edge 38: 3 mm;

diameter of the vertical bottom part with a height of 7 mm on the outer wall 34 of the base=52.5 mm; diameter at the end of the chamfered top portion (height 3 mm)=50 mm outside height of the returned edge 39=2 mm.

The casing 33 fitted with the connected base 31 was used in a pump dispenser of the non-return type, in which the intake to the pump was fitted with an immersion tube, the filling volume being 70% of the interior volume. Discharge by vacuum does not require fixing by gluing, this method being however preferred for security of the fixing and for making the container tamper-proof.

It is likewise possible to use a connected base such as 31 provided with an orifice through which air can pass, the base being placed in position after fitting of a piston which slides in the casing which is without a bottom of any kind, the distribution means likewise being a pump with no air-return facility. Filling of the distributor is then typically carried out through the opening at the top of the dome before the pump is fixed to the dome by crimping, but it is likewise possible to fill it from the bottom of the casing before inserting the sliding piston and preferably before fitment of the connected base which has the air passage facility.

Figure 11:
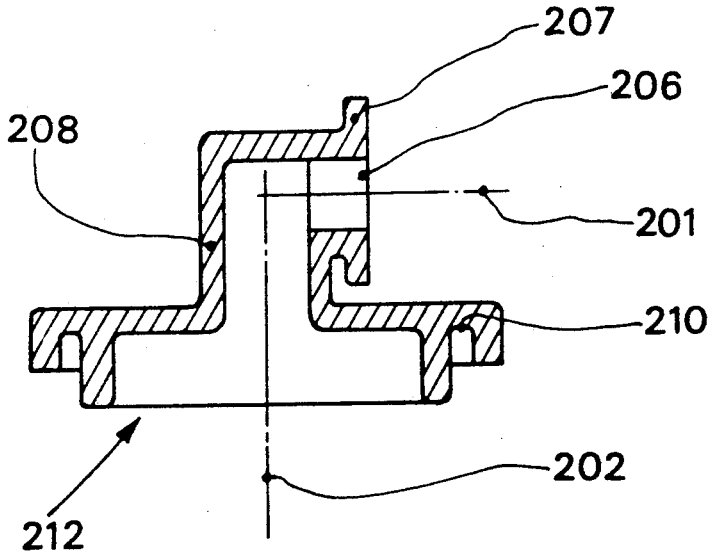
FIG. 11 shows a dome with a lateral outlet, in cross-section.

FIG. 11 shows an example of distributor arrangements which may be obtained with a plastics dome. The dome shown diagrammatically at 212 has an outlet orifice and a ring 207 for mounting distributing means which have a lateral axis 201, in this case at approx. 90° from the axis 202 of symmetry of the groove 210 for fixing the dome 212 on a casing. The member 208 of this dome is considerably asymmetrical.

The invention can be used in the cosmetics, pharmaceuticals, hygiene and foodstuffs fields, for storage and distribution of liquid or creamy products.

We claim:

1. A distributor body comprising a housing having a bottom, a lateral wall secured to said bottom and a top end opposite to said bottom, and a dome sealingly fixed to said top end, said dome being rigid and formed of a plastic material and comprising a central annular portion having a minimal thickness of between 1.2 and 4 mm, an upper annular portion and a lower annular portion, said lower annular portion sealingly fixing said dome to said top portion by direct axial fitment, said upper annular portion adapted for receiving distribution means, said upper and lower annular portions extending and framing said central annular portion, and a distribution means comprising a pump or a valve, fixed to said upper annular portion, having outlet means external to said upper annular portion.

2. An annular dome (2) of plastics material comprising an annular portion (8) of minimal thickness between 1.2 and 4 mm framed by an outwardly flared annular top end (8) and a wider bottom end portion comprising an annular groove (10) having a cross-section which is open semi-circular at least in part, by which it can be mounted over the rolled edge (12) of a housing (3).

3. An annular dome of plastics material (112) comprising an annular portion of minimal thickness between 1.2 and 4 mm framed by an outwardly flared annular top end and a wider bottom end skirt (113) comprising an annular vertical interior surface, said surface making it possible to fit the straight narrowed annular portion (110) of the tubular body of a casing of plastics or metal coated with plastics material (103) to said narrowed annular portion (110) in sealing-tight manner by gluing or welding.

4. An annular dome (2; 112) according to claim 2 or 3, wherein the annular disc (8) has a minimal thickness of between 1.5 and 3 mm and which is of a material selected from the group consisting of polyamides, polycarbonates, polyesters, polyacetal, polypropylene and polyethylene.

5. An annular dome (102) according to claim 4, of polyolefine, having an interior surface (28) provided with an annular barrier washer (27) fixed by moulding, said washer (27) comprising at least surface layers of polyolefine compatible with the said polyolefine of the dome (102) and an intermediate layer of Al or barrier plastics material.

6. A distributor body comprising a housing having a bottom, a lateral wall secured to said bottom and a top end opposite to said bottom, and a dome sealingly fixed to said top end, said dome being rigid and formed of a plastic material and comprising a central annular portion having a minimal thickness of between 1.2 and 4 mm, an upper annular portion and a lower annular portion, said lower annular portion sealingly fixing said dome to said top portion by direct axial fitment, said upper annular portion adapted for receiving distribution means, said upper and lower annular portions extending and framing said central annular portion.

7. A distributor body according to claim 6, wherein at least the lateral wall of the housing (103) is of plastics material or of metal externally coated with plastics material, said lateral wall comprising at its top end a straight restricted annular portion (110) bonded to the interior surface of a skirt (113) forming the lower annular portion of said dome (112) by gluing or welding.

8. A distributor body (1; 100) according to claim 6, wherein at least the lateral wall (3, 5) of the (3; 53) is metallic, the lateral wall comprising at its top end a rolled edge (12) and the (9) for mounting the said dome (2; 102) comprising an open annular groove (10) fitted in sealing-tight manner on said rolled edge (12).

9. A distributor body (1; 100) according to claim 8, wherein said annular groove (10) is glued onto the rolled edge (12).

10. A distributor body (1) according to claim 8 wherein said dome comprises an outer skirt (19) edging said annular groove (10) which forms a plastics extension member which extends into the interior of the rolled edge (12) of the casing (3).

11. A distributor body according to claim 8, comprising an annular member (20) of plastics material bearing on the lateral wall of the housing (3) below the rolled edge (12) and maintained captive between said rolled edge (12) and said lower annular portion of the dome, the dome (2) being welded around said annular member (20) on at least one annular connecting surface (24, 25).

12. A distributor body (1) according to claim 8 wherein said annular groove (10) is fixed to said rolled edge (12) by an intermediate plastics member (18) welded to the respective surfaces of said groove (10) and said rolled edge (12).

13. A distributor body (1) according to claim 12, wherein at least the lateral wall (3) is formed of aluminum or an alloy thereof and the annular dome (2) is of polyolefine, said intermediate piece (18) formed of plastics material containing EAA and said polyolefine.

14. A distributor body (1) according to any one of claims 6 or 7 to 13, wherein the dome (2; 102; 112; 212) is of a material selected from the group consisting of polyamides, polycarbonates, polyesters, polyacetal, polypropylene and polyethylene.

15. A distributor body according to claim 14, wherein the lower annular portion (8; 208) of the annular dome (2; 102; 112; 212) has a minimum thickness of between 1.5 preferably between 1.7 and 2.5 mm.

16. A distributor body according to claim 15, wherein the minimum thickness of said lower annular portion is between 1.7 and 2.5 mm.

17. A distributor body according to any one of claims 6 or 7 to 13, wherein the central annular portion (208) of the dome (212) is asymmetrical, and includes a laterally oriented aperture (206) at its upper annular portion (207) which is adapted to receive distribution means.

18. A distributor body (1; 100; 200) according to any one of claims 6 or 6 to 13, wherein the housing (3; 53; 440; 203) has a metallic lateral wall and an extruded, drawn or pressed-drawn monobloc metal bottom, or a a crimped-on metal bottom.

19. A distributor body (1) according to claim 18, wherein the lateral wall (3, 5) is of aluminum or an alloy thereof or tin plate and has an outside diameter and a thickness according to one of the following relationships:

diam. 33 mm up to 47 mm, and thickness 0.15 to 0.20 mm;

diam. 47 mm up to 55 mm, and thickness 0.20 to 0.25 mm;

diam. 55 mm to 80 mm, and thickness 0.25 to 0.35 mm.

20. A distributor body according to any one of claims 6 or 7 to 13, wherein the outer portion of the lateral wall (32) of the housing (33) is force fitted around a resiliently and transversely deformable tubular outer wall (34) of a connected base (31), said tubular wall (34) constituting the outside of an annular fold (42) which is open at the bottom and of having inside wall (36) extended in sealing-tight manner by a central bottom (37), said outer wall (34) being extended by an outer annular edge (38) of minimal width which stops and protects the bottom end of said lateral wall (32) of the casing (33).

21. A distributor body according to claim 20, wherein the housing (33) comprises a piston which slides in sealing-tight manner therein and wherein the central bottom (37) of the connected base (31) comprises at least one orifice which passes through it.

22. A distributor body (200) according to any one of claims 6 or 8 to 13, wherein the housing is of metal or metal coated with plastics and comprises a monobloc bottom (4) in which there is at least one through bore (130) and a top necked end (47), and a piston sliding in sealing tight manner within the casing between said bottom and said top necked end.

23. A distributor body (100) according to any one of claims 6 or 7 to 13 comprising a valve (16') for dispensing an aerosol product mounted in sealing-tight manner by crimping a neck or metal fixing cup (15) on the upper annular portion (7), which is outwardly flared, the casing (53) having a monobloc or crimped sealing-tight bottom (40).

24. A distributor body according to any one of claims 6 or 7 to 13 comprising a pump for distributing a liquid or cream fixed in sealing-tight manner by a neck or fixing cup on the upper annular portion of the annular dome which is outwardly flared, the casing (33) comprising a piston which slides in sealing-tight manner inside the housing (33) having no bottom or having a connected bottom through which air can pass.

25. A distributor body according to claim 24 wherein the distribution pump (16) is a pump without air-return.

26. A distributor body (200) according to any one of claims 6 or 7 to 13 comprising a pump (16) for distributing a liquid or a cream fixed in sealing-tight manner by a neck or fixing cup on the upper annular portion, (7) of the annular dome (2) which is outwardly flared, the casing (440) being of metal or a metal coated with plastic material and having a monobloc bottom (14) through which air can pass, and a necked top end (47) comprising a piston (45) which slides in sealing-tight manner between said bottom (4) and said necked top end (47).

27. A distributor (140) according to claim 26 in which the distribution pump (16) is a pump with no air-return facility.

28. A distributor body (100) according to any one of claims 6 or 7 to 13 comprising a pump (16) for distributing a liquid or a cream fixed in sealing-tight manner by a neck or fixing cup (15) on the upper annular portion (7) of the annular dome (2) which is outwardly flared, the housing (53) of said body (100) having a fixed sealing-tight bottom (40).

29. A distributor body according to claim 28 wherein the pump is a pump (16) without air-return and having an intake aperture fitted with a plunger tube (43).

30. A distributor body according to claim 29 in a state of delivery after filling, containing a liquid or the cream occupying 60 to 75% of its interior volume.

* * * * *